US005927165A

United States Patent [19]

Vasudeva

[11] Patent Number: 5,927,165

[45] Date of Patent: Jul. 27, 1999

[54] HEX KEYS AND OTHER TOOLS WITH NON-SLIP FEATURE

[75] Inventor: Kailash C. Vasudeva, Waterloo, Canada

[73] Assignee: Maxtech, Inc., Roseville, Mich.

[21] Appl. No.: 08/958,139

[22] Filed: Oct. 28, 1997

Related U.S. Application Data

[60] Provisional application No. 60/029,832, Oct. 28, 1996.

[51] Int. Cl.[6] ..... B25B 23/08

[52] U.S. Cl. ..... 81/448; 81/442; 81/443

[58] Field of Search ..... 81/436, 442, 443, 81/448, 449, 452

[56] References Cited

U.S. PATENT DOCUMENTS 785,162 3/1905 Freytag ..... 81/442
2,455,005 11/1948 Hall ..... 81/443
3,733,937 5/1973 Mezey ..... 81/448
5,179,877 1/1993 Down et al. ..... 81/442

*Primary Examiner*—David A. Scherbel
*Assistant Examiner*—Joni B. Danganan
*Attorney, Agent, or Firm*—R. Craig Armstrong

[57] ABSTRACT

The fastener-driving tool has an locking insert which expands or displaces to more securely lock the tool in the fastener. The tool has a distal end configured to engage a driving recess in a fastener, and has an annular recess adjacent the distal end, with a reduced cross-section at the annular recess, other than an axial circular cross-section. A locking insert having a generally similar cross-section to that of the distal end is positioned in the annular recess closely around the reduced cross-section. The locking insert may have a split portion which permits expansion of the locking insert when acted upon by the reduced cross-section as a result of rotation of the distal end relative to the locking insert, or may provide locking simply by displacement resulting from being acted upon by the reduced cross-section.

13 Claims, 4 Drawing Sheets

HEX KEYS AND OTHER TOOLS WITH NON-SLIP FEATURE

REFERENCE TO RELATED APPLICATION

This is a formal application based on provisional application No. 60/029,832, filed Oct. 28, 1996.

BACKGROUND OF THE INVENTION

This invention relates to hand tools, and in particular to hand tools such as a hex key, screwdriver, screwdriver bits or the like for applying torque to a fastener.

A common problem in all such situations is that as the torque is applied, the tool tends to slip out of the fastener, particularly but not only when the tool does not fit the fastener precisely due to tolerance variations, wear and tear on the tool and/or fastener, or other reasons. The greater the torque applied, the greater the tendency for the tool to slip or pop out of the fastener.

SUMMARY OF THE INVENTION

In the invention, a fastener-driving tool is provided with an insert which expands or displaces slightly to more securely lock the tool in the fastener. The tool has a distal end configured to engage a driving recess in a fastener, and has an annular recess adjacent the distal end, with a reduced cross-section at the annular recess, other than an axial circular cross-section. A locking insert having a generally similar cross-section to that of the distal end is positioned in the annular recess closely around the reduced cross-section, the locking insert being expandable or displaceable to lock the distal end more securely in the fastener, as will be explained in greater detail below.

BRIEF DESCRIPTION OF THE DRAWINGS

The invention will now be described in greater detail, with reference to the accompanying drawings of preferred and alternative embodiments of a hex key, for example, in which.

DETAILED DESCRIPTION

Figure 1:
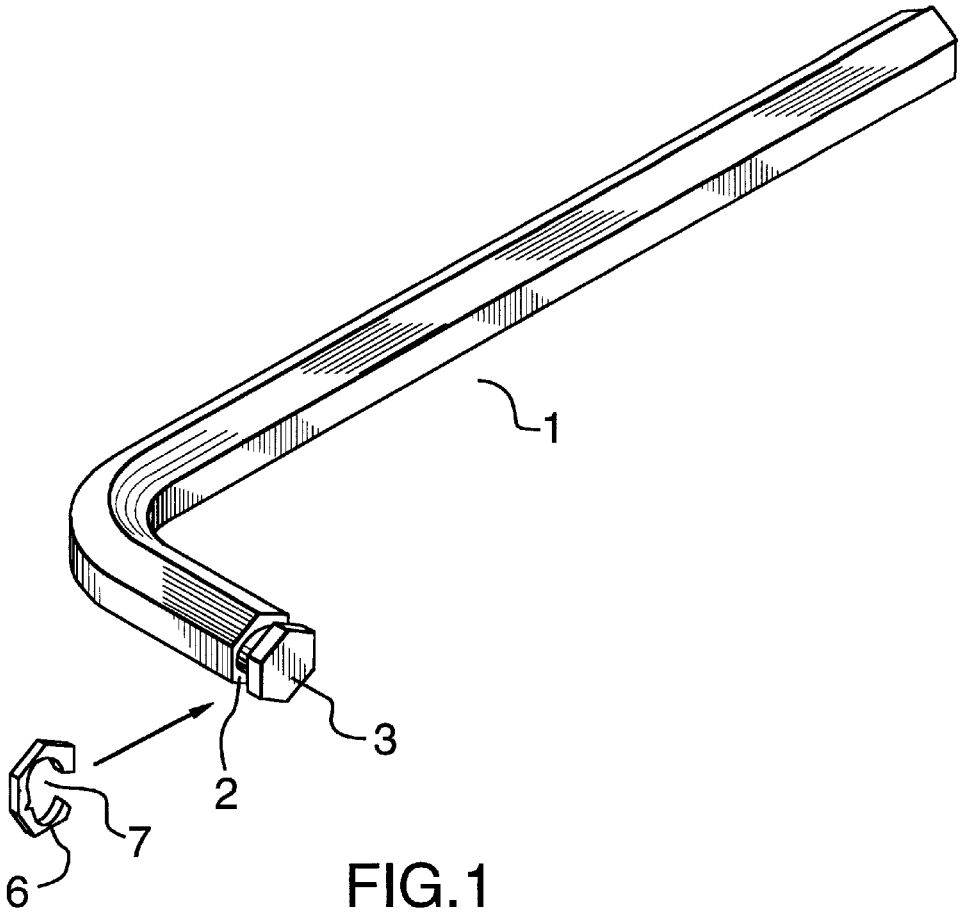
FIG. 1 is a perspective view of the hex key, before installation of an expandable locking insert.
Figure 2:
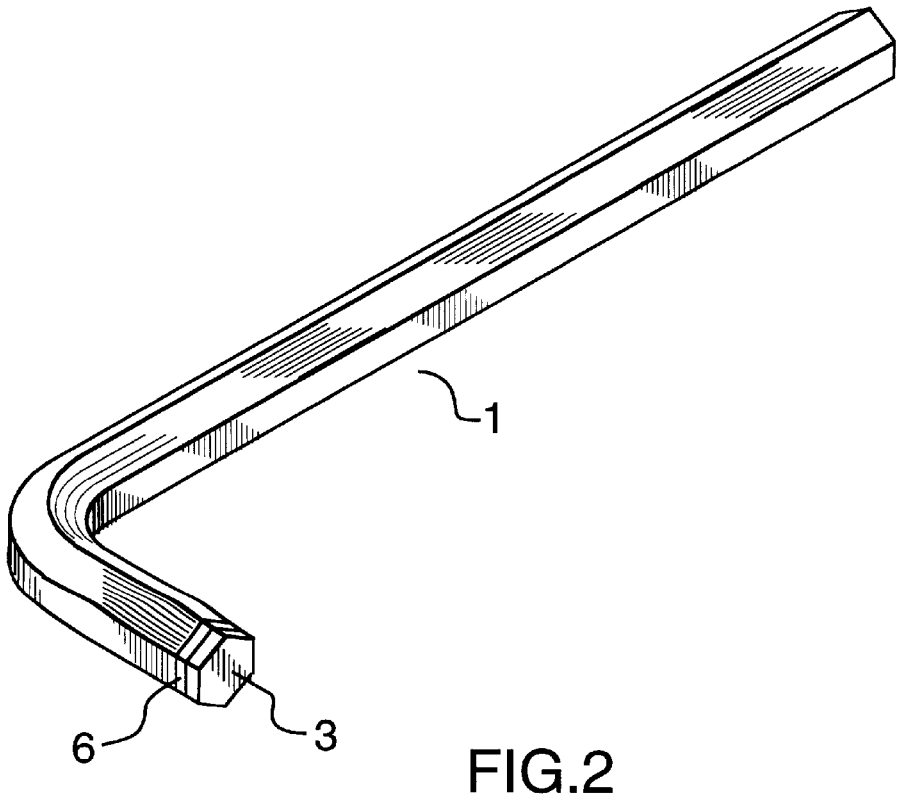
FIG. 2 is a perspective view of the hex key, with the locking insert installed.
Figure 3:
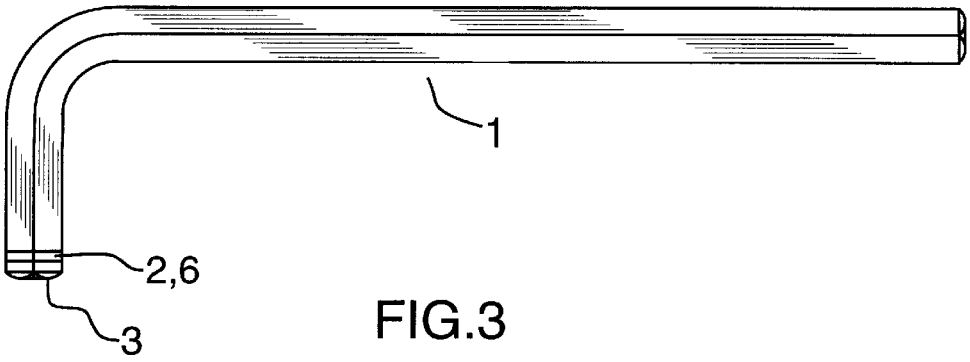
FIG. 3 is a side view of the hex key.
Figure 4:
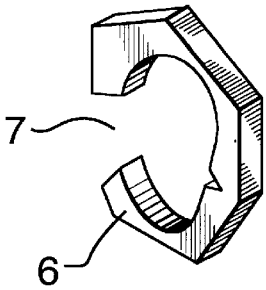
FIG. 4 is a perspective view of the locking insert.
Figure 6:
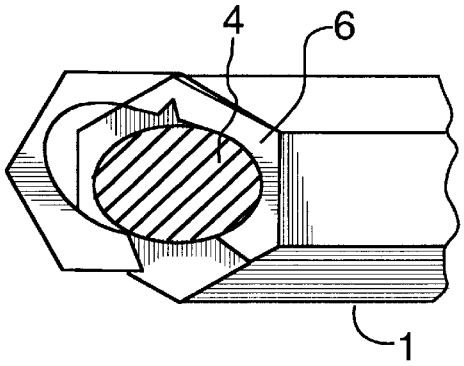
FIG. 6 is a cross-sectional view showing the locking insert being installed.
Figure 5:
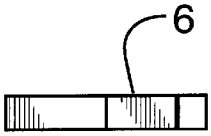
FIG. 5 is a side view of the locking insert.
Figure 7:
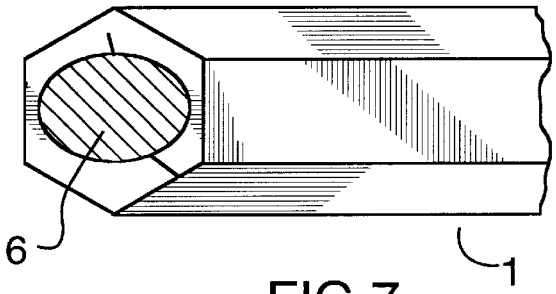
FIG. 7 is a cross-sectional view with the locking insert installed.
Figure 8:
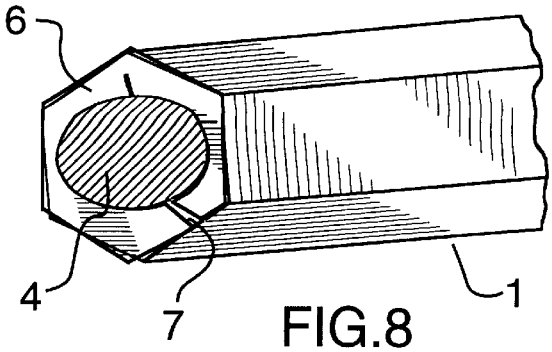
FIG. 8 is a cross-sectional view showing the locking insert in an expanded condition.
Figure 9:
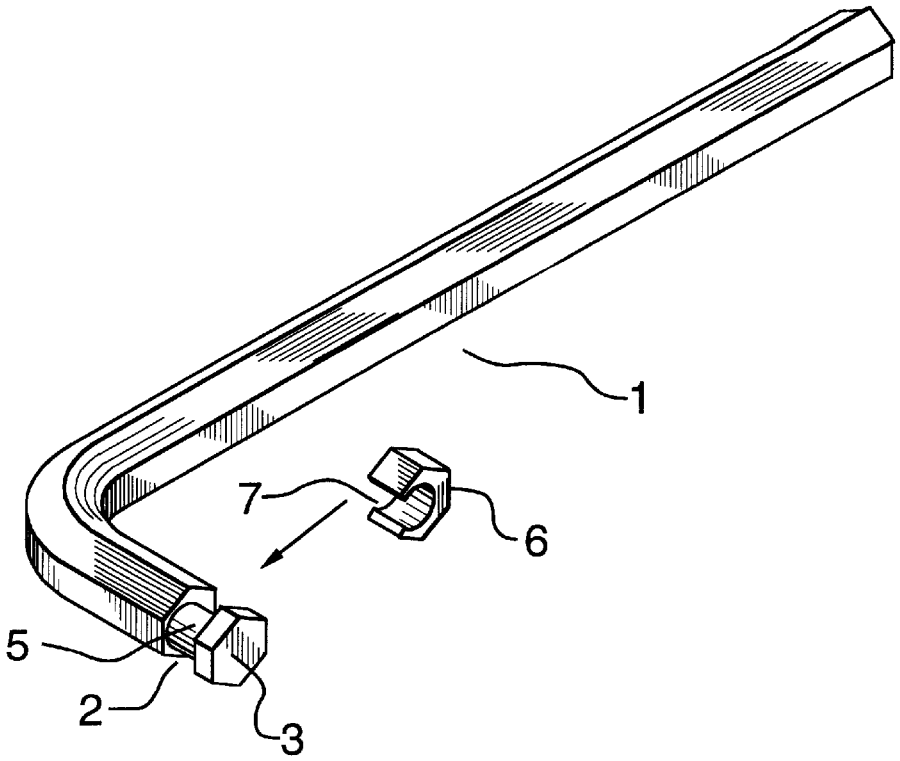
FIG. 9 is a perspective view of an alternative embodiment of the hex key, before installation of a displaceable eccentric locking insert.
Figure 10:
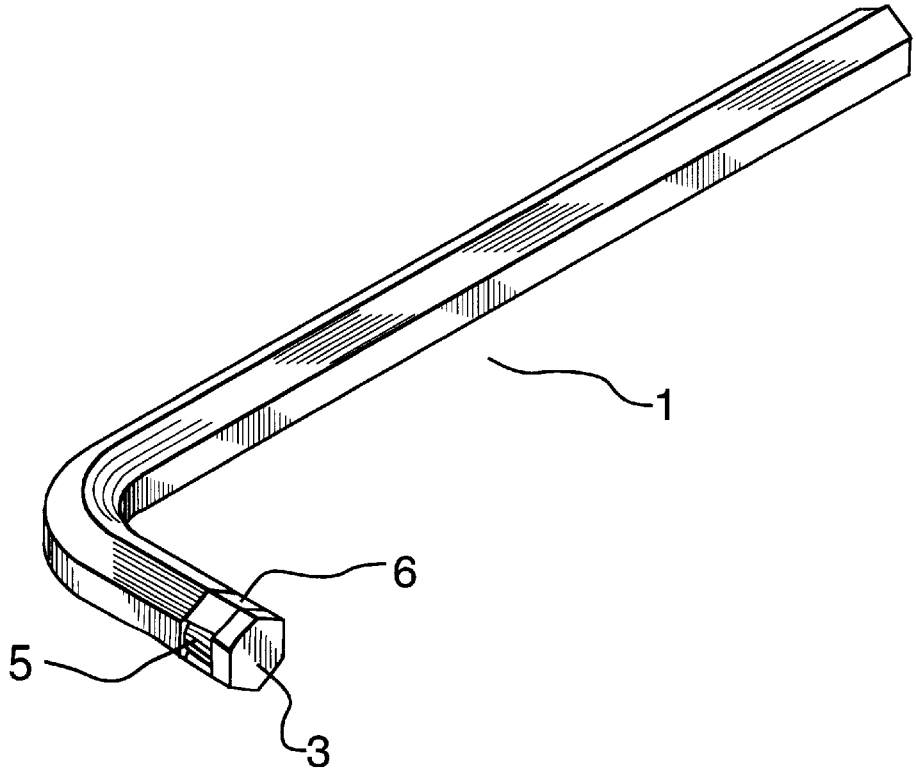
FIG. 10 is a perspective view of the alternative embodiment, with the eccentric locking insert installed.
Figure 11:
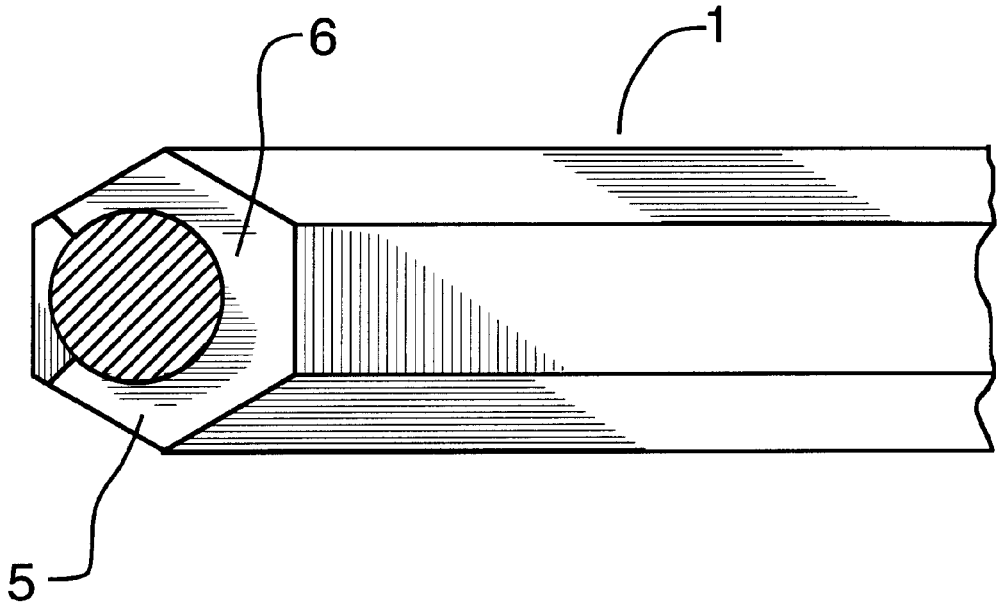
FIG. 11 is a cross-sectional view of the alternative embodiment, with the eccentric locking insert installed.
Figure 12:
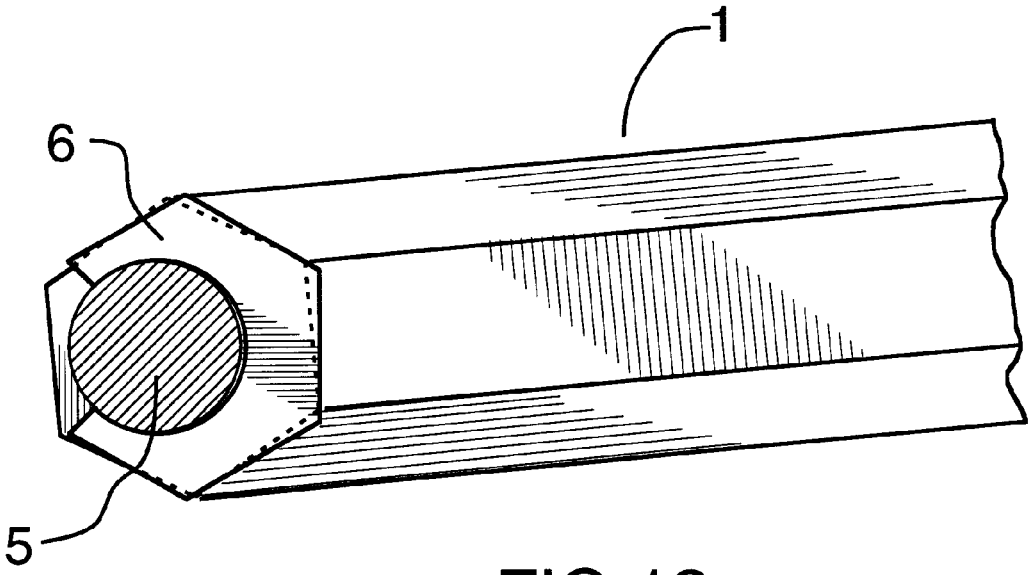
FIG. 12 is a cross-sectional view of the alternative embodiment, showing the eccentric locking insert in a displaced condition.

In the invention, referring to a hex key 1 as an example, an annular recess 2 is machined or formed adjacent the tool's distal working end 3, leaving a non-symmetrical or non-circular cross-section, such as an elliptical portion 4 (FIGS. 1–8), or an off-center (eccentric) circular portion 5 (FIGS. 9–12). The distance of the recess from the end of the tool is determined by the depth of engagement of the tool in the particular fastener for which the tool is sized. In the case of a hex key, for example, the locking insert must be close enough to the end of the hex key to fit at least partially within the hexagonal recess on the fastener.

Referring to the embodiment of FIGS. 1–8, an expandable locking insert 6, made from hardened spring steel or the like, is stamped and pressed/fitted into the recess. A notch 7 on one edge of the insert permits installation onto the recess, the insert being sufficiently flexible to permit this without permanent deformation. The insert has a central aperture matching the cross-section of the recess. If desired, the insert can be kept captive with a small screw through a slotted hole (not illustrated).

The hex key is used in the normal way to either tighten or loosen a fastener. If the distal end of the hex key begins to slip within the fastener, the locking insert will tend to stay in its proper position, since there is no torque being applied to it. Thus there will be relative rotation between the distal end and the locking insert, which causes the cross-section of the recess to act against the locking insert, such that the locking insert opens via the notch 7 to expand outwardly into the fastener opening, thus locking the tool in place and preventing further slippage. The cross-section can be oval as shown in FIGS. 1–8, or triangular, square, hexagonal or any other compound shape which will tend to expand the insert.

Referring to the embodiment of FIGS. 9–12, the cross-section can be circular, as long as it is eccentric, i.e. not co-axial with the axis of the distal end of the tool. In this embodiment, the displacement of the insert due to relative rotation does not produce expansion of the insert, but the displacement itself is sufficient to lock the tool.

Clearly, the same principle can be applied to a wide variety of tools for a corresponding wide variety of fasteners. For example, although this list is not intended to be all-inclusive, it is contemplated that the principle of the invention could be used also with various fastener drivers, including nut drivers and screwdrivers generally, and Robertson screwdrivers, Torx hex keys, Torx screwdrivers, Phillips screwdrivers, and various power bits. As long as the fastener has a sufficient depth to accommodate the locking insert or inserts fully or at least partially, the invention should be readily adaptable to any fastener.

I claim:

1. A fastener-driving tool having a distal end configured to engage a driving recess in a fastener, comprising an annular recess adjacent said distal end, said annular recess having a non-circular cross-section, further comprising a locking insert having external dimensions approximating those of said driving recess, positioned in said annular recess closely around said non-circular cross-section, said locking insert being expandable when acted upon by said non-circular cross-section as a result of rotation of said distal end relative to said locking insert.

2. A fastener-driving tool as recited in claim 1, wherein said locking insert is flexible and has a split portion which permits expansion of said locking insert.

3. A fastener-driving tool as recited in claim 2, wherein said reduced cross-section is coaxial with said distal end.

4. A fastener-driving tool as recited in claim 1, wherein said tool is a hex key.

5. A fastener-driving tool as recited in claim 1, wherein said tool is a screwdriver.

6. A fastener-driving tool as recited in claim 1, wherein said tool is a nut driver.

7. A fastener-driving tool as recited in claim 1, wherein said tool is a power bit driver.

8. A fastener-driving tool as recited in claim 1, wherein said non-circular cross-section is elliptical.

9. A fastener-driving tool having a distal end configured to engage a driving recess in a fastener, comprising an annular recess adjacent said distal end, said annular recess having a circular cross-section with an axis offset from an axis of said tool, further comprising a locking insert having external dimensions approximating those of said driving recess, positioned in said annular recess closely around said circular cross-section, said locking insert being displaceable when acted upon by said circular cross-section as a result of rotation of said distal end relative to said locking insert.

10. A fastener-driving tool as recited in claim 9, wherein said tool is a hex key.

11. A fastener-driving tool as recited in claim 9, wherein said tool is a screwdriver.

12. A fastener-driving tool as recited in claim 9, wherein said tool is a nut driver.

13. A fastener-driving tool as recited in claim 9, wherein said tool is a power bit driver.

* * * * *